United States Patent [19]

Yoshida

[11] Patent Number: 4,834,040

[45] Date of Patent: May 30, 1989

[54] OIL PUMP COVER WHICH ADAPTS A VOLKSWAGEN ENGINE TO A FULL FLOW AUXILIARY OIL SYSTEM

[75] Inventor: Minuro B. Yoshida, Huntington Beach, Calif.

[73] Assignees: Roger C. Turner, Newport Beach; Haruo Kimura, Huntington Beach, both of Calif. ; a part interest

[21] Appl. No.: 174,823

[22] Filed: Mar. 29, 1988

[51] Int. Cl.[4] ..... F02B 77/00

[52] U.S. Cl. ..... 123/198 C; 123/196 R; 184/6.28

[58] Field of Search ..... 123/196 R, 196 AB, 195 C, 123/196 A, 198 C; 184/6.28

[56] References Cited

U.S. PATENT DOCUMENTS

| | | | |
|---|---|---|---|
| 4,370,957 | 2/1983 | Skatsche et al. | 123/196 R |
| 4,423,708 | 1/1984 | Sweetland | 123/196 R |
| 4,424,778 | 1/1984 | Yoshida | 123/196 R |

OTHER PUBLICATIONS

J. C. Whitney & Co., Parts & Accessories 1976, p. 124.
J. C. Whitney & Co., Parts & Accessories, 1984 p. 270.

*Primary Examiner*—E. Rollins Cross

[57] ABSTRACT

An oil pump cover is provided which converts a standard Volkswagen type air-cooled engine into a full flow oil system for the installation of auxiliary oil filters and coolers by merely replacing the standard oil pump cover with the cover of the present invention. The cover includes a baffle for segregating a discharge chamber of the oil pump into a first (outlet) compartment and a second (return inlet) compartment. The cover includes an outlet recess for communicating with the first compartment and has an outlet passage extending from the outlet recess to the exterior of the cover, forming an outlet. The cover further includes an oil return inlet recess for communicating with the second compartment and has a passage extending from the inlet recess to the exterior of the cover forming a return inlet. The auxiliary oil filter or cooler is installed at a remote location on a vehicle and is connected by suitable hoses to the inlet and outlet of the oil pump cover.

18 Claims, 4 Drawing Sheets

OIL PUMP COVER WHICH ADAPTS A VOLKSWAGEN ENGINE TO A FULL FLOW AUXILIARY OIL SYSTEM

BACKGROUND OF THE INVENTION

The invention relates to a full flow auxiliary oil system for an air-cooled engine, and more particularly to an oil pump cover which adapts a Volkswagen type engine for a full flow auxiliary oil cooler or filter.

Air-cooled engines are typically provided with oil filters and coolers because the integrity and temperature of the oil is an important factor in determining the temperature of the engine and an important factor in engine life and performance. For example, early Volkswagen type engines were provided with an oil cooler which was located within an air cooling fan shroud of the engine. The air within the fan shroud would circulate around the oil cooler and thereby also cool the engine oil as well as circulate air over the cylinders. With the advent of off-road vehicles and higher performance demands on the engine, it has become advantageous to add auxiliary oil filtering capabilities and larger oil cooling capacity far beyond that provided by the standard engine. The engine compartments of such vehicles are usually quite confined and also very hot. It is therefore advantageous to locate the auxiliary oil system remotely from the engine compartment, typically on the exterior side or roof of the vehicle, where it is exposed to cooler exterior air flow.

The prior art has provided numerous engine modifications and adapters to convert the standard Volkswagen type engine to that of a full flow system for the remote location of an auxiliary filter or cooler.

One method of providing such a full flow auxiliary system involved the drilling into the engine block through an oil high-pressure passage, then tapping threads for an oil hose fitting. Then similarly, drilling, tapping and installing a hose fitting for the return of the oil to the engine. An auxiliary oil cooler, for example, was then installed remotely from the engine compartment and interconnected by oil hoses to the respective fittings on the engine. This process involved substantial time and skill in removing and reinstalling the engine as well as the precision installation of the oil fittings, and represented a substantial expense to the owner of the vehicle.

Another early approach, by the present inventor, is shown in U.S. Pat. No. 4,424,778 in which a coupler was installed at the standard oil cooler location which provides for the installation of an auxiliary oil cooler. The use of the coupler required that the engine shroud be removed, the oil cooler be removed, the coupler then be installed, then the standard oil cooler reattached at the coupler, then the auxiliary oil cooler and lines be attached to the coupler at the rear of the engine, the shroud was modified for clearance of the new lines and cooler, then the shroud was reinstalled on the engine. This device required substantial time, skill and expense for the installation.

Additional adapters are available which are attached at the oil cooler location which replace the oil cooler with a device which provides an outlet and inlet for a full flow auxiliary oil system. A disadvantage of these adapters is that the remote cooler performs properly so long as the vehicle is moving, but when stationary, such as in heavy traffic, the cooling of the replacement coolers are not exposed to the air flow within the shroud and the oil cooling is often inadequate under such conditions. In addition, these devices also require removal of the engine shroud; the oil cooler, installation of the device, and reinstallation of the shroud, all at substantial time, effort and expense to the owner.

SUMMARY OF THE INVENTION

Accordingly, it is an object of the present invention to provide a full flow auxiliary oil system to a Volkswagen type engine which is quickly and easily installed.

It is another object to provide a system which allows the original oil filter and cooler to function in the usual manner and to supplement the filtering and cooling capacity with a full flow auxiliary system.

These objects are accomplished with a unique oil pump cover which readily provide an outlet and a return inlet for an auxiliary full flow system by the mere removal of four nuts at the lower front of the engine which retain the oil pump cover and replacing the original flat plate oil pump cover with the oil pump cover of the present invention. The oil pump for a Volkswagen type engine includes a housing enclosing a pair of drive gears and includes a suction chamber in communication with the engine oil supply and a discharge chamber having a first passage in communication with the engine oil circulation system. The oil pump cover of the present invention includes an inner surface having a baffle extending generally perpendicularly therefrom for segregating the discharge chamber into a first compartment and a second compartment, wherein the second compartment includes the first passage to the engine oil circulation system. The cover further includes a first recess for communicating with the first compartment and has a second passage extending from the first recess to the exterior end of the cover forming an outlet. The cover includes a second recess for communicating with the second compartment and has a third passage extending from this second recess to the exterior end of the cover forming an oil return inlet. When the cover is attached to the oil pump of the Volkswagen engine, it forms a full flow oil system to facilitate the attachment of an auxiliary oil filter, oil cooler or the like to the inlet and the outlet of the cover.

BRIEF DESCRIPTION OF THE DRAWINGS

While the novel features of the invention are set forth with particularity in the appended claims, the invention will be better understood along with other features thereof from the following detailed description taken in conjunction with the drawings, in which:

DETAILED DESCRIPTION OF THE INVENTION

Figure 1:
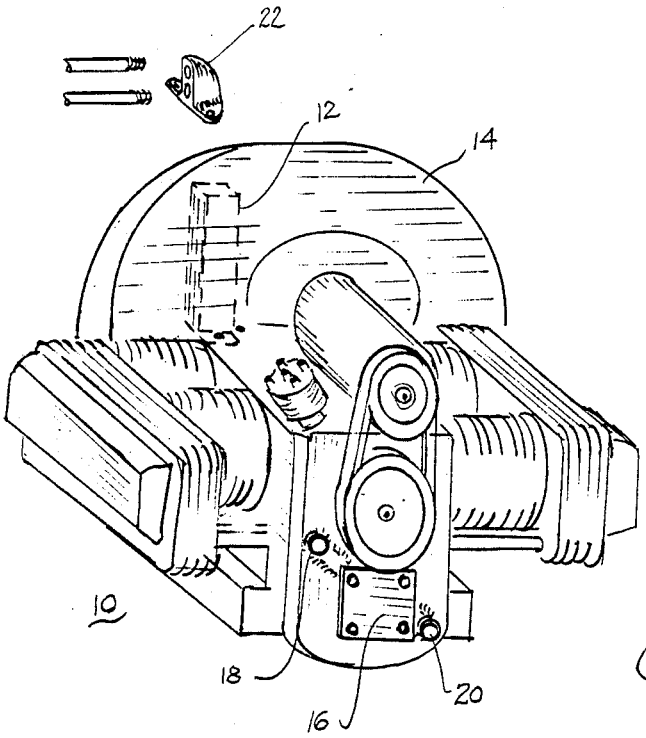
FIG 1 (PRIOR ART)
FIG. 1 is a front perspective view of a typical Volkswagen type air-cooled engine (and a partially exploded view of an adapter of the prior art)

Referring to FIG. 1, a typical early Volkswagen type air-cooled engine 10 is shown having a standard oil cooler 12 installed on the lower rear of the engine and located within an air cooling fan shroud 14. The engine has an oil pump located at the lower front and enclosed under a flat plate standard pump cover 16.

As discussed in the Background of the Invention, one prior art method of adapting the standard engine to a full flow auxiliary oil system involved removal of the engine, then drilling a hole in the engine block into a high pressure oil passage, then tapping threads and installing a hosing fitting, such as at 18; and also drilling, tapping and installing a similar hose fitting, such as at 20 for an oil return inlet. After reinstallation of the engine, an auxiliary oil filter or cooler was remotely attached to the vehicle and connected to the engine by suitable hoses at the fittings 18 and 20. This procedure is time consuming and requires the services of a skilled mechanic and results in a substantial expense to the owner.

Other prior art devices utilized the oil outlet and oil inlet located on the engine at the standard oil cooler 12 to adapt the engine for a remote oil filter or cooler. This required removal of the fan shroud 14 located at the rear of the engine. The shroud has engine components, wiring and actuation cables attached thereto and has numerous fasteners securing it to the engine, and is difficult to remove. Upon removal of the shroud, the oil cooler 12 was then removed and an adapter 22 having oil outlet and inlet fittings is bolted in its place. A remote oil filter or cooler (not shown) is installed on the vehicle and connected to the adapter by suitable hoses. The shroud 14 is then reinstalled. Installation of such an adapter 22 is extremely time consuming and usually requires the services of a professional mechanic at substantial expense.

Figure 2:
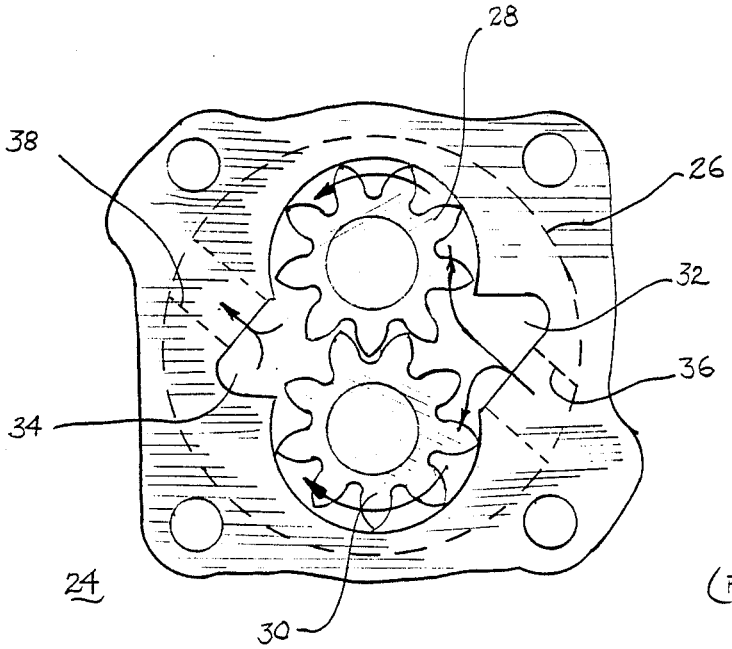
FIG 2 (PRIOR ART)
FIG. 2 is an enlarged front elevation view showing the interior of a typical oil pump.
Figure 3:
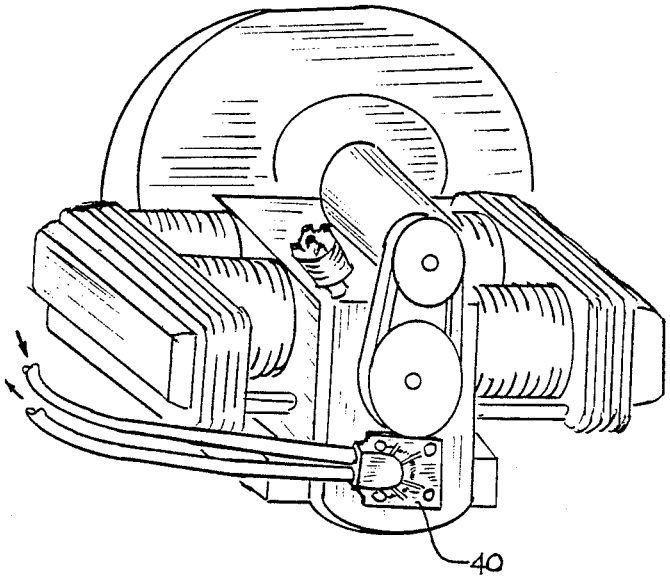
FIG. 3 is a front perspective view of a typical Volkswagen type engine having the oil pump cover of the present invention installed thereon.

To better understand the present invention, it is essential to understand the structure and operation of an oil pump. A typical oil pump 24 is illustrated particularly in FIGS. 2 and 4. The oil pump 24 comprises a cast aluminum generally cylindrical housing 26 enclosing a pair of rotatable pump gears 28, 30, has a suction chamber 32, a discharge chamber 34 and a front flange 35. The oil pump is installed within a recess in the lower front of the engine at about the level of the engine oil supply and is enclosed at the front flange by a standard flat plate oil pump cover 16 secured by four nuts on four studs extending from the engine. The suction chamber 32 includes a passage 36 which communicates with the engine oil supply to provide oil to the suction chamber. The upper pump gear 28 has a rear shaft lug engaged with the engine cam shaft (not shown) to drive the pump by rotating this gear 28 in a counter-clockwise rotation; and the engagement of the teeth of drive gear 28 with the teeth of gear 30 rotates gear 30 in a clockwise rotation. The oil in the suction chamber 32 is carried by the chambers between each tooth of gears 28 and 30 around the internal housing to the discharge chamber 34. The discharge chamber 34 includes a passage 38 which communicates with the engine oil circulation network in which oil is forced to the crank shaft bearings, push rods, valve lifters, etc. to lubricate the engine.

Referring also to FIGS. 3 through 9, the present invention provides a unique oil pump cover 40 which replaces the standard flat plate oil cover 16 on the engine. The pump cover 40 comprises a generally flat inner-surface 42 which seals the front of the pump on the engine, a unique baffle 44 which extends generally perpendicularly from the inner surface and is sized for segregating the discharge chamber 34, an outlet recess 46, an outlet passage 48, a return inlet passage 50, and an inlet recess 52.

Figure 4:
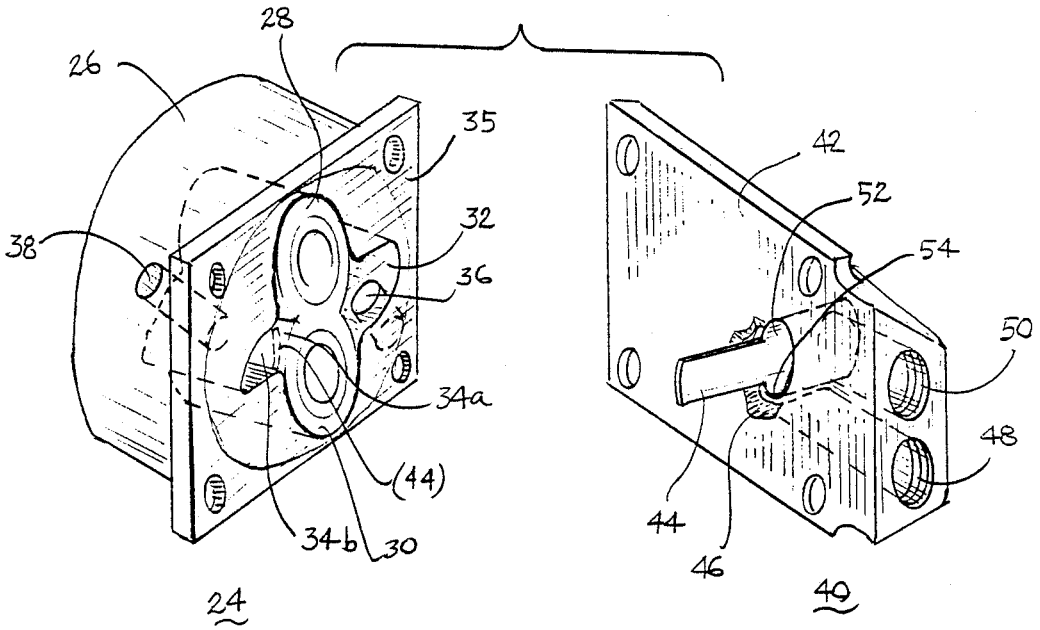
FIG. 4 is a front perspective view showing the oil pump cover of the present invention adjacent to the oil pump.
Figure 5:
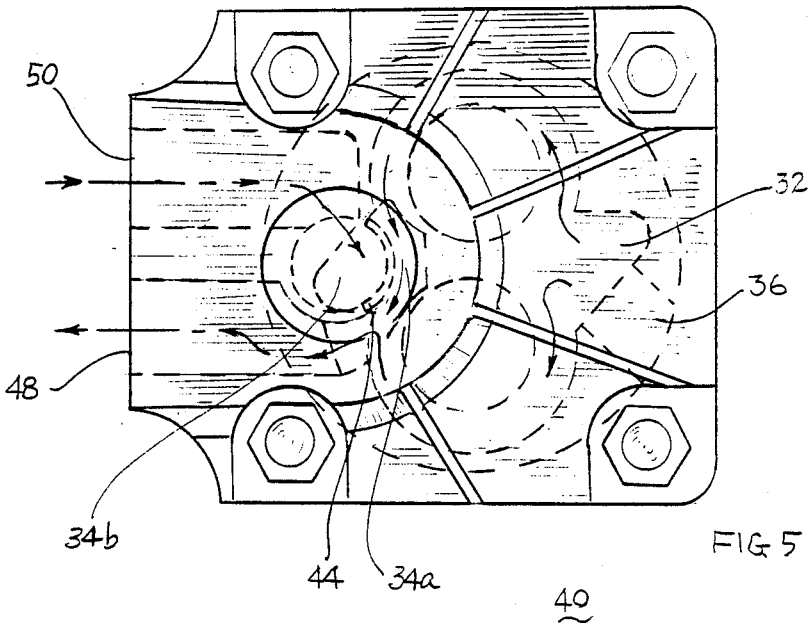
FIG. 5 is an enlarged front perspective view of the oil pump cover installed on the oil pump with respective passage shown in dashed lines.
Figure 6:
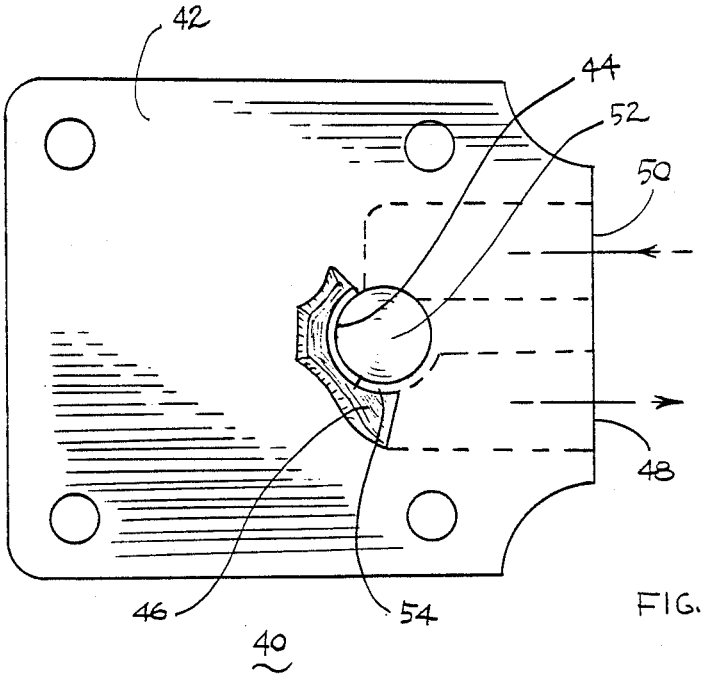
FIG. 6 is a rear elevational view showing the inner surface of the oil pump cover with the respective passages shown in dashed lines.
Figure 9:
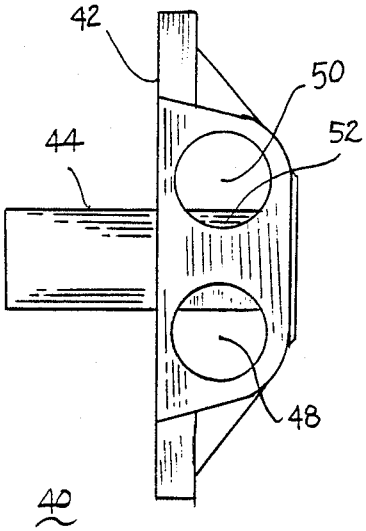
FIG. 9 is a left side elevational view of the pump cover.
Figure 7:
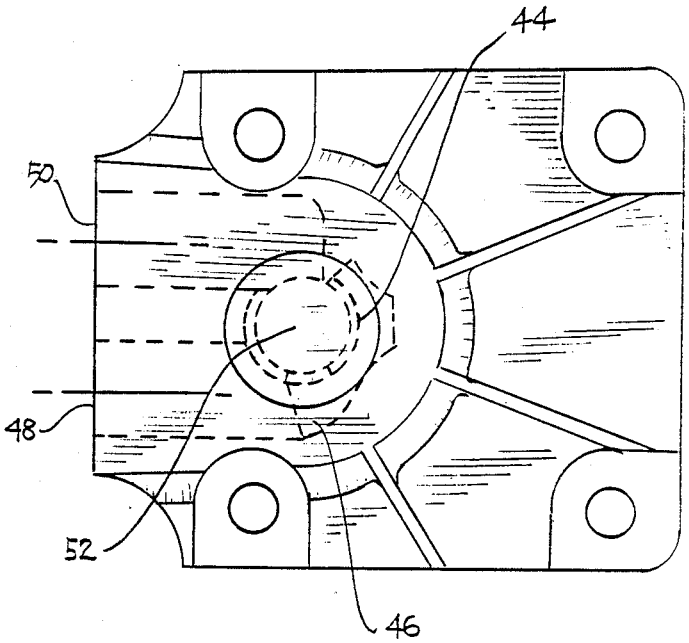
FIG. 7 is a front elevational view of the pump cover.
Figure 8:
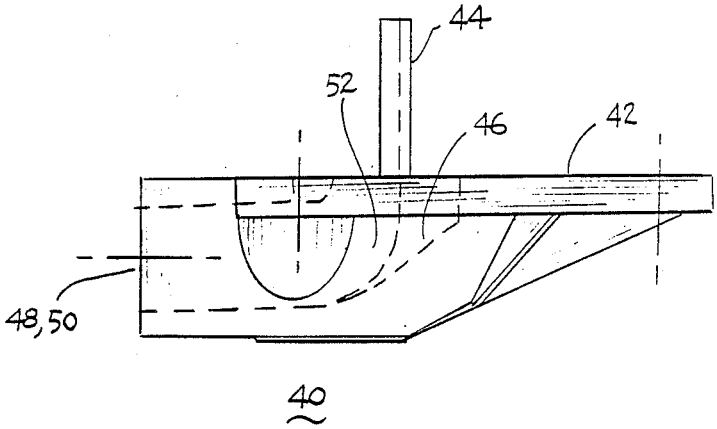
FIG. 8 is a top plan view of the pump cover.

Upon installation of the pump cover 40, the baffle 44 extends into the full longitudinal depth of the discharge chamber 34 of the oil pump, and spans the base of the chamber opening, essentially segregating the discharge chamber 34 into two discreet, (substantially sealed) compartments, illustrated in FIG. 4 as first compartment 34*a* and second compartment 34*b*, wherein Compartment 34*b* includes the discharge passage 38.

The inner surface 42 of the pump cover includes the discharge outlet recess 46 which corresponds in shape to the shape of compartment 34*a* (defined by baffle 44 and the base of the gear teeth on gears 28 and 30 within the compartment. The outlet recess 46 smoothly increases in depth to communicate with the outlet passage 48 which extends to the exterior surface at the end of the cover. The outlet passage 48 includes internal threads adapted to receive a suitable fitting for connection of a suitable hose which is further connected to the inlet of an auxiliary oil cooler or oil filter or both in series. The return of the oil from the auxiliary cooler or filter back to the engine is provided by a suitable hose to the oil return inlet passage 50 having threads and a suitable fitting and located at the end of the pump cover. The return oil flows through the inlet passage 50 to the inlet recess 52 then out of the cover and further to the second compartment 34*b* of the discharge chamber to complete the auxiliary circuit then continues on through discharge passage 38 to the standard lubrication network system.

The inlet recess 52 communicates with in inlet passage 50 and is separated from the outlet recess 46 by the baffle 44 and a partition 54 formed in the cover. The inlet recess 52 is illustrated in the figures as having a generally cylindrical shape. The initial production of the present pump covers were fabricated from an aluminum casting in which the outlet recess 46 was formed directly in the casting. The outlet passage 48 was first machined into the end of the cover in communication with the outlet recess 46. The inner-surface was then roughly machined (perpendicularly bored) for the return inlet recess, into which a cylindrical length of tubing (about two inches in length) was pressed (about 0.75 inches) into the casting and sealed therein forming the inlet recess 52 and partition 54, and the extended tube was further machined to form the baffle 44 extending perpendicularly from the inner-surface of the cover. The return inlet passage 50 was then machined into the end of the cover to include penetration of the tubing to communicate the inlet passage 50 with the inlet recess 52. It is contemplated that the cover will eventually be fabricated entirely from a one-piece casting and the return inlet recess 52 will be preferably in a generally triangular shape corresponding to the shape of chamber 34*b*. The cover will function as described regardless of the shape of the passages and recesses but the smoother the flow, the better the performance through the system.

The pump cover could be fabricated or molded from any suitable aluminum, steel, ceramic, plastic or composite material. The exterior front surface of the cover is generally contoured to conform with the shape of the passages and preferably includes fins to facilitate cooling.

The baffle 44 was previously described as extending perpendicularly from the inner-surface 42 of the cover and when the cover is installed, the baffle spans the longitudinal base of the opening of chamber 34. The concave-convex shape (formed naturally by the arc of the inserted tubing) performs well with the convex surface matching with the fit of the gears in compartment 34*a*, and the concave surface defining compartment 34*b* which smoothly directs oil to the passage 38; however, the baffle could be flat, and generally planer in shape.

As an alternative means for segregating discharge chamber 34 into compartments 34*a* and 34*b*, a separate baffle (not specifically shown but similar in shape to baffle 44, only not integral with the pump cover) could be provided to be inserted and secured directly into the chamber 34 of the oil pump. The corresponding alternative cover would then include outlet recess 46 and inlet return recess 52 corresponding respectively to the compartments 34*a* and 34*b* of the discharge chamber but would not have the integral baffle 44. This two-piece design would simplify the casting and fabrication of the cover but would complicate the overall installation. This configuration could also be provided directly into an (after market) oil pump housing.

As a further alternate but less preferred configuration (not specifically shown), the pump cover could be designed to segregate the suction chamber 32 into an inlet compartment and an outlet compartment. Such a configuration would require a slightly larger baffle corresponding to the span of the suction chamber but would otherwise include an inlet recess and inlet passage and an outlet recess and outlet passage similarly in structure but opposite to flow to that described in the foregoing preferred embodiment. This configuration would operate on the low pressure or suction side of the pump rather than the high pressure side as previously described. Such a configuration would be contemplated where an auxiliary oil cooler or filter were to be mounted at a lower remote location, for example on the undercarriage of the vehicle. It is believed that this configuration would not perform as efficiently as in the dischrge chamber but would still fall within the scope of the present invention.

The foregoing embodiments of the invention illustrate that the formerly time consuming, complicated and expensive engine modification to a full flow auxiliary oil system is accomplished by a single component with which an owner can quickly and easily perform this conversion by replacement of the oil pump cover (secured by four readily accessible fasteners) on a do-it-yourself basis in a matter of minutes.

While specific embodiments of the present invention have been illustrated and described herein, it is realized that modifications and changes will occurred to those skilled in the art. It is therefore to be understood that the appended claims are intended to cover all such modifications and changes as fall within the true spirit and scope of the invention.

What is claimed is:

1. An improved cover for use on an oil pump of an engine wherein the oil pump includes a suction chamber in communication with the engine oil supply and a discharge chamber which has a first passage in communication with the engine oil circulation system, said cover comprising:

means for segregating the discharge chamber of the oil pump into a first compartment and a second compartment wherein the second compartment includes the first passage;

a first recess for communicating with the first compartment and having a second passage extending from said first recess to the exterior of said cover forming an outlet; and a second recess for communicating with the second compartment and having a third passage extending friom said second recess to the exterior of said cover forming an oil return inlet;

whereby, when said cover is attached to the oil pump, it forms an oil outlet and a return inlet to facilitate further attachment of an auxiliary oil cooler, oil filter or like component to the engine oil system.

2. The oil pump cover of claim 1 wherein said means for segregating the discharge chamber comprises a thin generally rectangularly shaped baffle having a width corresponding to the span of the opening of the discharge chamber and a length corresponding to the longitudinal depth of the discharge chamber with said baffle extending generally perpendicularly from the inner surface of said cover and adapted to segregate the discharge chamber into the respective compartments when said cover is installed on the oil pump of the engine.

3. The oil pump cover of claim 2 wherein the width of said baffle is further curved in an arc forming a convex surface for segregating the first compartment and a concave surface for segregating the second compartment.

4. The oil pump cover of claim 1 wherein said segregating means comprises a discrete thin component having a width corresponding to the span of the opening of the discharge chamber and a length corresponding to the longitudinal depth of the discharge chamber and said discrete component is not integral with said cover and is adapted to be installed directly into the discharge chamber of the oil pump.

5. The oil pump cover of claim 1 wherein said first passage and said second passage include connector means adapted to receive oil hoses.

6. The oil pump cover as in claim 5 wherein said connector means comprises internal screw threads adapted to receive threaded hose fittings.

7. The oil pump cover as in claim 1 wherein said cover is fabricated from a metallic casting.

8. The oil pump cover as in claim 7 wherein said metallic casting is composed substantially of aluminum.

9. The oil pump cover as in claim 7 wherein said metallic casting is composed substantially of steel.

10. The oil pump cover as in claim 7 further comprising a generally rectangular metallic component which is secured to the inner surface of said casting forming said baffle.

11. A cover for an oil pump of an air-cooled Volkswagen type engine wherein the oil pump includes a suction chamber in communication with the engine oil supply and a discharge chamber which has a first passage in communication with the engine oil circulation system, said cover comprising:

an inner surface having a baffle extending generally perpendicularly therefrom for segregating the discharge chamber of the oil pump into a first compartment and a second compartment wherein the second compartment includes the first passage;

a first recess for communicating with the first compartment and having a second passage extending from said first recess to the exterior of said cover forming an outlet; and a second recess for communicating with the second compartment and having a third passage extending from said second recess to the exterior of said cover forming an oil return inlet; whereby, when said cover is attached to the oil pump of the Volkswagen type engine, it forms a full flow oil system to facilitate the attachment of an auxiliary oil filter, oil cooler, or the like to said inlet and said outlet of said cover.

12. The oil pump cover of claim 11 further comprising means for interconnecting the respective passages of said cover to an auxiliary component of an oil system.

13. The oil pump cover of claim 12 further comprising an oil cooler.

14. The oil pump cover of claim 12 further comprising an oil filter

15. The oil pump cover of claim 11 further comprising a pair of hose fittings for installation into said passages, an auxiliary oil cooler, and a pair of oil hoses for interconnection said cooler to said respective fittings.

16. The oil pump cover of claim 11 further comprising a pair of hose fittings for installation into said passages, an auxiliary oil filter, and a pair of oil hoses for interconnection of said filter to said fittings.

17. A cover for an oil pump of an engine wherein the oil pump includes a suction chamber in communication with the engine oil supply and a discharge chamber which has a first passage in communication with the engine oil circulation system, said cover comprising:

means for segregating the discharge chamber into a first compartment and a second compartment wherein the second compartment includes the first passage;

means for communicating the first compartment to the exterior of said cover, forming an outlet; and means for communicating the second compartment to the exterior of the cover, forming an oil return inlet;

whereby, when said cover is attached to the oil pump, it forms an outlet and a return inlet to facilitate external attachment of an auxiliary oil cooler filter, or the like to the engine oil system.

18. A cover for an oil pump of an air-cooled Volkswagen type engine wherein the oil pump includes a suction chamber which has a first passage in communication with the engine oil supply and a discharge chamber in communication with the engine oil circulation system, said cover comprising:

an inner surface having a baffle extending generally perpendicularly therefrom for segregating the suction chamber of the oil pump into a first compartment and a second compartment wherein the first compartment includes the first passage;

a first recess for communicating with the first compartment and having a second passage extending from said first recess to the exterior of said cover forming an outlet; and a second recess for communicating with the second compartment and having a third passage extending from said second recess to the exterior of said cover forming an oil return inlet; whereby, when said cover is attached to the oil pump of the Volkswagen type engine, it forms a full flow oil system to facilitate the attachment of an auxiliary oil filter, oil cooler, or the like to said inlet and said outlet of said cover.

* * * * *